United States Patent [19]

Delarue et al.

[11] 3,955,254

[45] May 11, 1976

[54] APPARATUS FOR TREATING YARN WITH FLUID MATERIAL

[75] Inventors: Christian Delarue, Meyzieu; Roger Vidal, Champagne Au Mont d'Or, both of France

[73] Assignee: Rhone-Poulenc-Textile, Paris, France

[22] Filed: Apr. 17, 1974

[21] Appl. No.: 461,755

[30] Foreign Application Priority Data

Apr. 18, 1973 France ..... 73.14499

[52] U.S. Cl. ..... 28/1.6; 28/72.14; 28/75 WT; 68/200

[51] Int. Cl.[2] ..... D06B 11/00; D02G 1/12

[58] Field of Search ..... 8/14, 148, 149, 151, 8/151.2; 68/200, 205 R; 118/325, DIG. 21; 28/1.6, 72.14, 75 WT; 101/172

[56] References Cited

UNITED STATES PATENTS

| | | | |
|---|---|---|---|
| 3,570,275 | 3/1971 | Weber et al. | 68/205 R |
| 3,644,969 | 2/1972 | Guillermin et al. | 8/148 X |
| 3,808,618 | 5/1974 | Arimoto et al. | 68/200 X |

*Primary Examiner*—Stanley N. Gilreath
*Assistant Examiner*—Philip R. Coe
*Attorney, Agent, or Firm*—Sherman & Shalloway

[57] ABSTRACT

Methods of and apparatus for treating yarn with a fluid material include a chamber through which the yarn is advanced and an injection nozzle for impinging fluid on the yarn as it advances through the chamber. The injection nozzle is registered with a fluid circulation system in which a dyeing substance or other fluid treating substance or material is circulated. Upon interrupting the circulation of the fluid treating material, a portion of the material is diverted into the chamber through which the yarn is advancing. By interrupting the circulation of the fluid treating material according to a selected pattern, the fluid treating material will impinge on the advancing yarn with a corresponding pattern. If it is desired to impinge treating materials having different characteristics, such as dyes of different colors, then a plurality of circuits may be utilized to direct the fluid materials into the chamber through which the yarn advances. The fluid circuits may be controlled and coordinated according to selected patterns in order to produce a varying effect on the yarn progressing through the chamber.

9 Claims, 21 Drawing Figures

APPARATUS FOR TREATING YARN WITH FLUID MATERIAL

BACKGROUND OF THE INVENTION

1. Field of the Invention

The present invention relates to apparatus for treating textile material. More particularly, the present invention relates to apparatus for treating textile material with a fluid.

2. Technical Considerations and Prior Art

In the textile industry, it is a current practice to treat textile material while in yarn form with fluids that are impinged upon the yarn as the yarn is advanced through a chamber. Generally, for the purposes of this application, the term "yarn" includes any continuous length of textile material, regardless of its structure, that is subsequently made into textile fabrics. The yarn can be composed of a single filament, a thread which is made of fibers by processes such as twisting and interlacing, or any other arrangement. There may, of course, be numerous filaments or threads or, perhaps, just a single filament or thread.

Since the present invention is concerned with fluid treatment, the term "fluid" as used in this application is defined as a gaseous or liquid substance which may contain a dye or agents, such as anti-static agents, anti-stain agents, oiling agents, optical blueing agents, or softening agents. In addition, the fluid may contain agents such as ultra-violet absorbers, non-flammability chemicals, dye inhibitors, or fixing agents. In addition, the application of fluid includes the concept of injecting water with the fluid containing any or some of the above-described agents. All of these agents and chemicals are exemplary of the agents and chemicals which are, and may be, used to treat yarns in accordance with the processes and apparatus utilized in practicing the instant invention.

The prior art discloses several patents which are concerned with treating yarn with a fluid while the yarn is advanced through the chamber. For example, U.S. Pat. No. 2,854,728 discloses a process in which the yarn is treated in a curling or crimping chamber with a liquid, such as a dye or an oil, which is introduced into the chamber by an orifice and the flow of which is regulated by a valve provided with a manual regulating button. The treating liquid is injected into the curling or crimping chamber through an adjustable nozzle. However, with this device, uniform treatment of the yarn is not adequately achieved because there is heterogeneity of the dyeing process due to heterogeneity of temperature. In addition, the fixation of the oil or dye is not adequate due to insufficient heat treatment of the yarn. Finally, the apparatus of U.S. Pat. No. 2,854,728 permits the yarn to be dyed only one color.

French Pat. No. 1,499,744 discloses a device wherein the yarn is advanced through a treatment chamber while being dyed with a periodic pattern by impinging the dye on the yarn variably with a jacquard type mechanism of a weaving or knitting frame which is placed directly downstream from the yarn treatment chamber. In this device, the dye is fixed to the yarn while the yarn is in the chamber. This device is rather difficult to control and has the deficiency that there is no means for draining the dye from the chamber which, consequently, results in difficulties in fixing the dye to the yarn. Since there is a great deal of dye on the yarn, it is most difficult to increase the temperature of the yarn to a level allowing fixation of the dye.

In U.S. Pat. Nos. 3,644,969 and 3,751,778, which are assigned to the inventors of the instant invention, it is proposed to fabricate textured yarn at high speed, while simultaneously treating the yarn with a finishing agent or dye solution. In order to provide for this simultaneous treatment, it is necessary to use a fluid distribution device which has great flexibility in handling and operation. A successful fluid treatment device used in conjunction with the teachings of these patents ideally should be relatively compact, have few moving parts, be reliable and resist corrosion by various chemical agents present in fabrication plants. These features are especially important when processing yarn to obtain treated yarn having variable characteristics.

The apparatus proposed in the U.S. Pat. No. 2,854,728 and French Pat. No. 1,499,744 do not meet the afore-described requirements for a fluid distribution device because they disclose mechanical structures which require constant maintenance. In addition, the output adjustments are not satisfactory in that the adjustments disclosed in U.S. Pat. No. 2,854,728 are manual, and those described in French Pat. No. 1,499,744, while programmed, require a relatively large jacquard type mechanism which is not as reliable as desired. In addition, the fluid distribution devices of these prior patents are not responsive enough to be compatible with high speed operation in which fluid distribution must be varied rapidly.

SUMMARY OF THE INVENTION

In view of the afore-described deficiencies in the prior art, it is an object of this invention to provide new and improved apparatus for treating yarn with fluid.

It is another object of this invention to provide new and improved apparatus for treating yarns with fluids, wherein the treatment may be varied rapidly to give a varying pattern of treatment to the yarn.

It is an additional object of the instant invention to provide new and improved apparatus for controlling the impingement of a treatment fluid on yarn while the yarn is advanced through a chamber.

It is a further object of the instant invention to provide new and improved apparatus for controlling impingement of fluid on yarn, wherein the yarn is stuffed in a compacting chamber and wherein numerous fluid treatment products may be selectively applied to the yarn according to selected spacings and patterns.

It is still another object of the instant invention to provide new and improved apparatus for distributing fluid on yarn, wherein the operation of the processes disclosed in U.S. Pat. Nos. 3,644,969 and 3,751,778 is enhanced.

It is still a further object of the instant invention to provide a new and improved fluid distribution apparatus for impinging fluid on a yarn which has great flexibility.

An additional object of the instant invention is to provide new and improved apparatus for impinging fluid on yarn, wherein the apparatus is relatively compact, has few moving parts, and will resist the corrosive chemical agents present in most manufacturing facilities.

In view of these and other objects, an apparatus for practicing the principles of the instant invention may include a fluid circuit in which the treatment fluid in continuously circulated, and a conduit registered with a chamber through which the yarn passes and the fluid circuit. The circulating fluid is selectively diverted by a valve means into the conduit to impinge upon the yarn when circulation of the fluid in the fluid circuit is interrupted. By selectively interrupting circulation of the fluid according to a predetermined pattern, a desired pattern of impingement of the fluid on the yarn may be achieved.

The afore-described apparatus functions to provide a new and improved process which achieves the objects of the instant invention by selectively diverting circulating fluid upon interrupting circulation of that fluid to impinge the fluid upon yarn advancing through a closed member.

DETAILED DESCRIPTION

Figure 1:
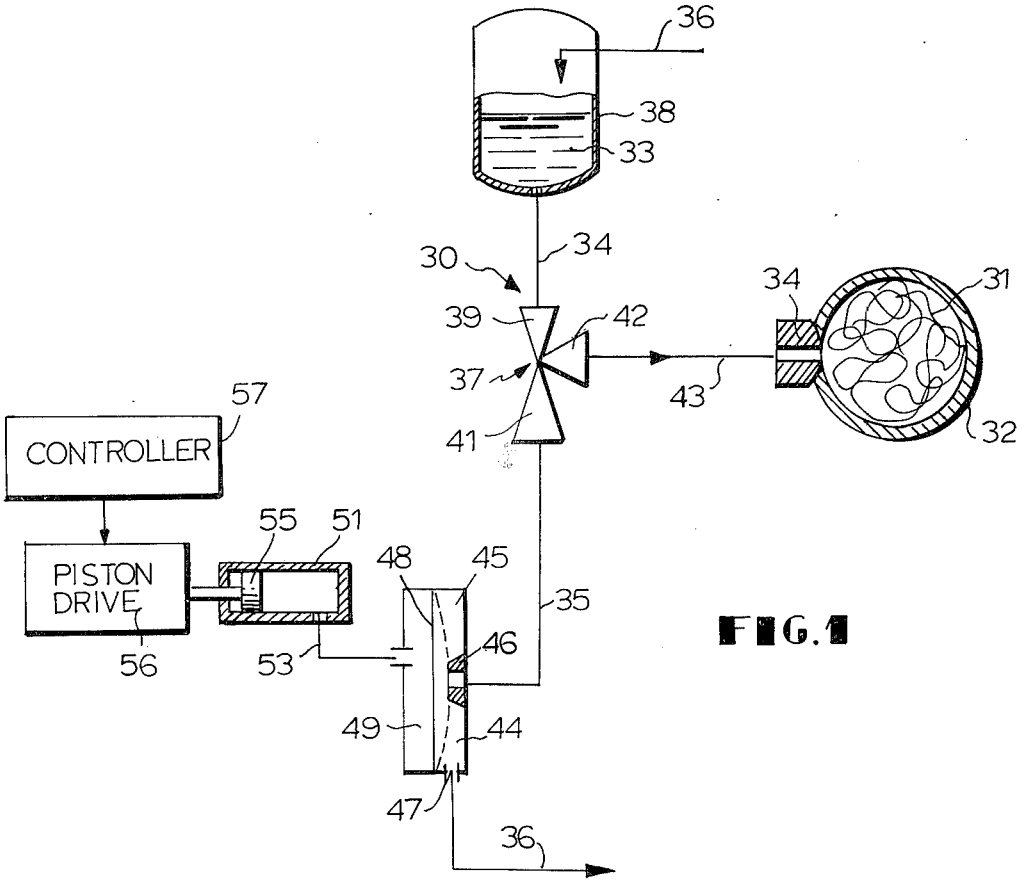
FIG. 1 is a schematic illustration of a system for impinging fluid onto yarn in accordance with the principles of the instant invention.

Referring now to FIG. 1, there is schematically shown a fluid treating apparatus, designated generally by the numeral 30, which operates in accordance with the principles of the instant invention. Fluid treating apparatus 30 treats yarn 31 which is advancing through a chamber 32 into which fluid 33 is injected by an injector 34. It should be kept in mind that the yarn 31 may be in any form. For example, it may be a single stand or it may be multiple strands which are either separate or interwoven. In other words, the yarn 31 may be in any of the forms in which yarn is configured as it is fluid treated. The chamber 32 may be a chamber in conformance with those chambers disclosed in U.S. Pat. Nos. 3,644,969 and 3,751,778. The chamber 32 receives and compacts the yarn by doubling the yarn up in a crimping configuration, as shown in the afore-described patents which are all incorporated in this present application by reference.

In accordance with the principles of the present invention, the fluid distribution system 30 continuously circulates fluid 33 through lines 34, 35 and 36 by an injector device, designated generally by the numeral 37. The fluid circuit prescribed by the lines 34, 35 and 36 also includes a reservoir or holding tank 38, which is located upstream from the injector device 37.

In operation, the fluid 33 is drawn through the line 34 by an ejector 39 and passes into an orifice schematically shown as 41 which is registered with the ejector

39. The ejector 39 is a conventional, well-known device which functions to eject the fluid 33 from an outlet orifice of the ejector 39 into the aligned orifice 41 which forms an inlet for the line 35. As the fluid 33 circulates, it will naturally flow from line 34 to line 35 due to the alignment of the afore-described orifices. However, registered with the outlet orifice of the ejector 39 and the inlet orifice 41 is another orifice schematically illustrated by the numeral 42. The orifice 42 is preferably what is generally referred to as an aspiration orifice, and it is generally, normally disposed to the alignment of the orifices of the afore-mentioned fluid circuit. Whenever flow of fluid 33 in the circuit 34, 35, 36 is interrupted downstream from the ejector 39, the fluid 33 will exit through the aspirator orifice 42 and flow through line 43 into injector 34 so as to impinge upon yarn 31 in the chamber 32.

In accordance with the principles of the instant invention, the afore-described interruption to divert the fluid 33 into the line 43 is accomplished by a throttling device schematically illustrated by numeral 44 which is disposed between the outlet end of line 35 and the inlet end of line 36. The throttling device 44, according to the instant invention, includes a chamber 45 having an inlet 46 with which the line 35 is registered, and an outlet 47 with which the line 36 is registered. According to one embodiment of the instant invention, a diaphragm 48 forms one wall of the chamber 45 and is disposed opposite the inlet 46. On the other side of the diaphragm 48, there is positioned a second chamber 49 that is completely closed from the chamber 45 by the diaphragm. Into the chamber 49 air is injected to deflect the diaphragm 48 against the inlet 46 to block the inlet 46 and prevent flow of fluid through the line 35. The fluid 33 then has no choice but to flow through line 43 and into the chamber 32.

While, for purposes of illustration, a pneumatic system is shown for closing the inlet 46, it is, of course, possible to use any convenient system, such as a mechanical system in which a valve closes the orifice or an electromechanical system in which a valve operated by a solenoid closes the system. For purposes of illustration, however, the pneumatic system may utilize a closed cylinder 51 having a line 53 registered with the chamber 49. A piston 55 may be reciprocated in the chamber 51 to pressure the chamber 49, and thereby close the inlet 46. Any sort of conveniently operated electrical or mechanical apparatus, generally designated by the numeral 56, may be used to reciprocate the piston 55. The apparatus 56, in turn, may be conveniently controlled or programmed by a controller 57 so as to deflect the diaphragm 48 according to a programmed pattern. The programmed pattern generated by the controller 57 controls the impingement of the fluid 33 on yarn 31 as the yarn 31 advances through the chamber 32.

It should be kept in mind that the amount of the fluid 33 diverted into the line 43 may be controlled by the degree to which the inlet 46 is throttled. In other words, by completely closing off the inlet 46, a great deal of the fluid 33 will be diverted to line 43. However, by just partially closing the inlet 46, a lesser amount of fluid 33 will be diverted because some fluid will still be able to pass from line 35 to line 36.

Figure 2:
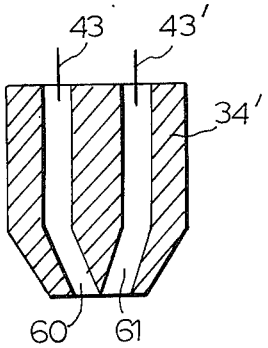
FIG. 2 is a schematic cross-sectional view of an injector which may be used with the system of FIG. 1, wherein two channels are provided for injection of fluid into a treating chamber.
Figure 3:
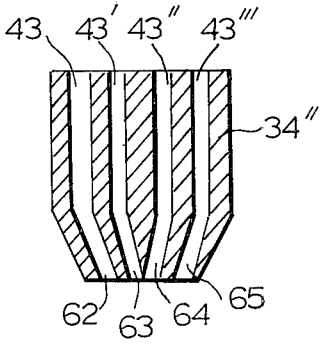
FIG. 3 is a schematic cross-sectional view of an injector for use with the system of FIG. 1, wherein four channels are provided for the injection of four fluids which may, for example, be dyes.

Referring now to FIGS. 2 and 3, there are shown alternative embodiments 34' and 34'' of the injector 34. With the injector 34', two fluids may be injected at a single location by having a pair of channels 60 and 61 with which separate lines 43 and 43′, respectively, are registered. The line 43, of course, may come from the system 30 of FIG. 1. However, a redundant system (not shown) similar or identical to the system 30 may be attached to the line 43′. While one system 30 diverts a first fluid through the line 43, a second system 30 can divert a second fluid or even an identical fluid through the line 43′. The fluid flowing through the lines 43 and 43′ may be pulsed and varied according to desired patterns so as to impinge the fluids on yarn 30 according to desired patterns. For example, fluid flowing in line 43 may be red, while the fluid flowing through the line 43′ may be a sickly green. By, for example, alternating the diversion into line 43 with the diversion into line 43′ and alternating pattern of red and green will appear on the yarn 31.

Referring now specifically to FIG. 3 where there is shown an injector 34″, four channels 62, 63, 64 and 65 are shown which register with lines 43, 43′, 43″ and 43‴. An injector, such as the injector 34″, would have four systems 30 such as that shown in FIG. 1 so that four different fluids might be programmed to pass through the various channels 62 through 65. For example, the fluids flowing through channels 62, 63 and 64 might consist of fluids containing dye solutions of the three basic colors (green, yellow and red), while the channel 65 may be a dye additive. By utilizing the system of FIG. 3, it is possible to dye the yarn 31 according to any desired color through selecting and dosing the various dye solutions.

Figure 4:
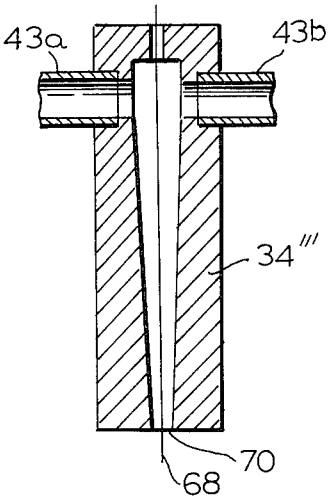
FIG. 4 is a cross-sectional view of one embodiment of an injector according to the principles of the instant invention, wherein two fluids are injected.

Referring now to FIG. 4, there is shown an injector 34‴ which is another embodiment that the injector 34 of FIG. 1 may assume to impinge fluid onto the yarn 31. The injector 34‴ has a pair of inlet lines 43*a* and 43*b* through which fluids from separate systems such as the system 30 of FIG. 1, are injected. With the injector 34, the fluid arriving through channel 43*a* and that arriving through 43*b* are separated by a plate 68 so that the passage section is constant. Consequently, it is possible to obtain an orifice 70 with a thin slit at the level of the yarn 31 being treated without interrupting the velocity of the treating fluid. With this system, it is possible to obtain a delivery having a constant speed.

Figure 5:
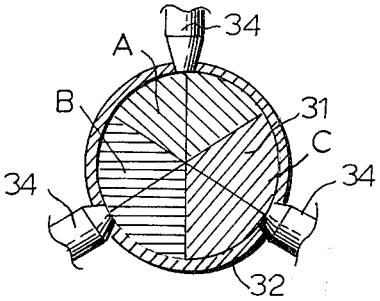
FIG. 5 is a cross-sectional view of a chamber showing three injectors registered therewith.
Figure 6:
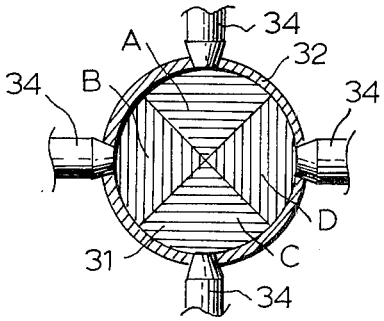
FIG. 6 is a cross-sectional view of a chamber showing four injectors registered therewith.
Figure 7:
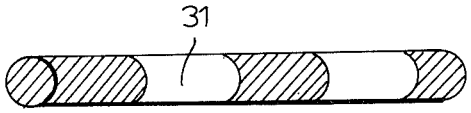
FIGS. 7 through 21 are figures schematically showing the appearance of yarn resulting from various fluid treatments performed in accordance with the principles of the instant invention.
Figure 9:
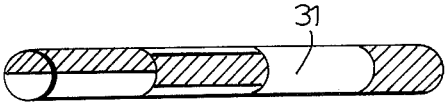
Figure 8:
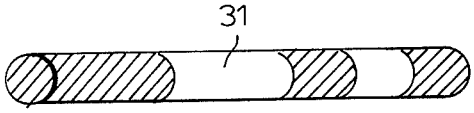
Figure 10:
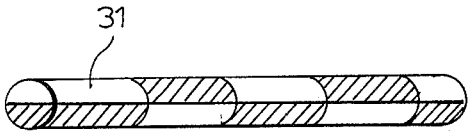
Figure 11:
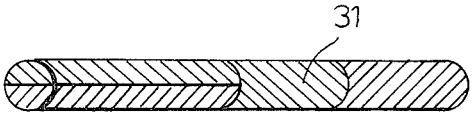

Referring now to FIGS. 5 and 6, there are shown arrangements wherein pluralities of injectors 34 are circumferentially arranged around the chamber 32. The arrangement of FIG. 5 can, for example, be used with the processes and apparatus described in the afore-mentioned U.S. Pat. Nos. 3,644,969 and 3,751,778 which are incorporated by reference in this application, and are assigned to the instant inventors. With the injector devices 34 of FIG. 5, it is possible to act on three zones *a*, *b* and *c* simultaneously. When dyeing yarn 31 which is formed in the chamber as a pile, there are many different possibilities which can be pursued in using the arrangement of FIG. 5. For example, one of the zones *a*, *b*, *c* could be dyed while the other two zones are left natural, or the three zones could each be dyed different colors, and so forth. It should be remembered that as the pile 31 is being dyed, it is advancing longitudinally along the axis of the chamber 32 so that the dyes are distributed along the lengths of the pile, as well as through the pile. By pulsing the injectors 34 with the system 30 according to selected patterns, it is possible to generate numerous dyeing patterns in the pile.

Referring now specifically to FIG. 6, there is shown an arrangement similar to FIG. 5. However, this time, four injectors 34 are utilized, resulting in a situation where the individual dyeing zones *a*, *b*, *c* and *d* are more compact, and wherein additional variations in the dyeing pattern of the pile of yarn 31 may be achieved.

Referring now to FIGS. 7 through 21, there are shown schematic illustrations of yarn treated by the apparatus and according to the process of the instant invention while in the form of a pile. As seen in these figures, the various configurations are a function of the number of injectors, the number of different fluids used, and the frequency of injection. The longer the diaphragm 48 (see FIG. 1) remains closed, the longer will be the length of each treatment zone.

FIGS. 7 through 12 are exemplary of the appearance of piles of yarn 31 treated with a device according to the instant invention where two injectors 34 (not shown) and two different fluids are used.

Figure 13:
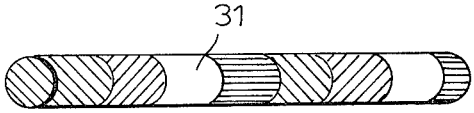
Figure 14:
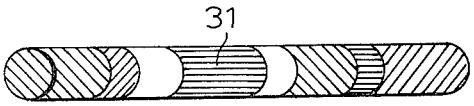
Figure 15:
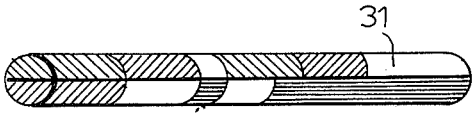

FIGS. 13 through 15 are exemplary of appearances of piles of yarn 31 after treatment, wherein two injectors are utilized with four fluids. In this case, the two injectors each resemble the injector 34′ of FIG. 2, or the injector 34‴ of FIG. 4.

Figure 16:
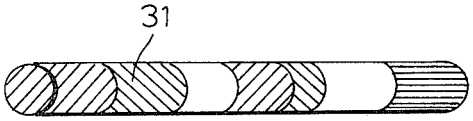
Figure 12:
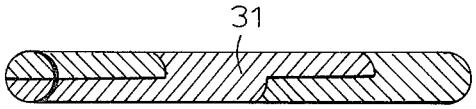
Figure 17:
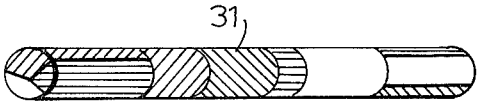

FIGS. 16 and 17 are exemplary of the appearances of piles of yarn 31 after treatment where three injectors or groups of injectors, as illustrated in FIG. 5, are used, and four different fluids are used.

Figure 18:
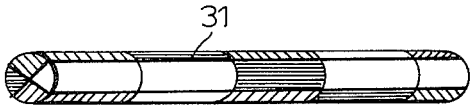
Figure 19:
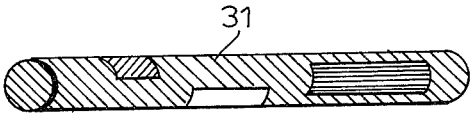
Figure 20:
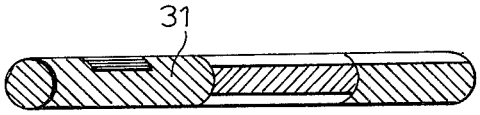

FIGS. 18 through 20 are exemplary of appearances of piles of yarn 31 after treatment where four injectors 34 or groups of injectors are used with four fluids, as illustrated in the embodiment of FIG. 6.

Figure 21:
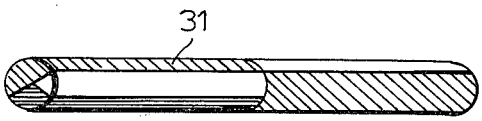

Finally, FIG. 21 is illustrative of the situation where a pile of yarn 31 is treated with four injectors 34 or groups of injectors, and three fluids.

The FIGS. 7 through 21 illustrate the flexibility obtainable by utilizing the processes and apparatus of the instant invention. These results can be obtained either simultaneously with or, on the other hand, not simultaneously with texturization of yarns, as exemplified in the inventor's other afore-mentioned patent applications. After the products illustrated in FIGS. 7 through 21 are obtained, they may be used either in the form of a pile or the yarn 31 may be unwound from the pile formed in the chamber 32 and rewound on a spool. In addition, while the pile is unwound, it may be continuously twisted to obtain a multi-filament strand having the appearance of a uniformly colored yarn or, on the other hand, a marbled yarn or perhaps either a cloud yarn or assembled false yarn. Again, it is emphasized that the system has great flexibility for producing yarns 31 of various dye patterns and configurations.

Further, expanding on the flexibility of the inventors' process and apparatus, it should be kept in mind that several strands of yarn 31 may be treated at the same time, as well as treating a single strand. These several strands may undergo a uniform or heterogeneous treatment, and the treated yarns may be further processed either individually or together. As described in French Pat. application No. 73/05089, filed Feb. 8, 1973, the piles resulting may be either totally cut or partially cut to obtain either separate dyed fibers or by additionally using continuous or delayed twisting, a thread or fibers. When treating roves or strips of fibers, it is possible to utilize the apparatus of the instant invention with a spinning device to produce a thread of dyed fibers by what is known as an open end spinning process.

Finally, it is emphasized that the textile materials treated in accordance with the process and apparatus of the instant invention can be utilized in weaving, knitting or for fabrication of unwoven articles. The method and apparatus of the instant invention can be used to produce materials for all possible textile applications, such as those relating to clothing, furniture, floor or wall coverings, other technical applications and so forth.

EXAMPLES

EXAMPLE 1

The method and apparatus of the instant invention was practiced by using an embodiment where two dyes were alternately injected into a crimping chamber with a constant frequency of alteration. The apparatus on which the apparatus of the instant invention was mounted was that described in U.S. Pat. No. 3,752,778 which is utilized to cause simultaneous texturization and dyeing of yarn by piling and compressing the yarn in a chamber with a current generated by an expanding compressed fluid. In this situation, a compressed fluid was steam elevated to a temperature causing fixation of the yarn. The pile in this example is carried through the chamber by the expanding steam, while a portion of the steam escapes laterally from the chamber through lateral ports therein. With this arrangement, the dyes are introduced into the chamber to impinge upon the piling, while the piling is passed continuously into a release zone, a steam injection zone, and then finally into a second release zone. In utilizing the process and apparatus of the instant invention with U.S. Pat. No. 3,752,778, the treatment conditions for continuous yarn made of polyhexamethylene adipamide (polyamide 66) having a count of 2,300 dtex/136 strands were as follows:

| | |
|---|---|
| Speed of supply of the yarn for texturization | 406m/min. |
| Speed of the leaving pile | 4.5m/min. |
| Speed of winding of the yarn after unravelling the pile | 332m/min. |
| Pressure of steam supply at the input of the texturization chamber | 8 bars |
| Pressure of the steam inside the closed volume or closed chamber and in the injection zone which follows the release zone | 3 bars |
| Temperature of the steam on the yarn at texturization | 136°C. |

In this example, a configuration shown in FIG. 6 was used with four injectors 34 spaced at 90° around the crimping chamber 32. Each injector was of the type shown in FIG. 2 and having the reference numeral 34', wherein each injector has two channels similar to channels 60 and 61. With this example, two circuits similar to the circuits of FIG. 1 were utilized, each circuit having separate dye solutions circulating therein. The injection modulation means and program means were combined as shown in FIG. 1 in the form of a programmed pneumo-hydrolic injection system, such as the type developed by the company Bertin et Compagnie.

The dyes used were an aqueous solution of brilliant polar blue RAWL (C.I. No. 61,585) in a concentration of 40g/l and an aqueous solution of Fuller yellow 2R (C.I. No. 25,135), also in a concentration of 40g/l.

The dye solutions are injected alternately at a constant frequency of one cycle per second, and with a quantity of 38cc per injector per 100g of yarn per minute. These parameters are used to obtain alternately dyed zones on the pile having a constant length of 61mm, and having an appearance such as that schematically shown in FIG. 8. The resulting wound and unwound yarn has dyed sections with the length of 1,445mm measured by putting the yarn under a tension of 100g in the texturized state, wherein the yarn has a count of 2,850 dtex.

EXAMPLE 2

In this example, the apparatus and process of FIG. 1 were utilized for alternate injection of two dyes with a variable injection frequency. The differences between this example and Example 1 are as follows:

| | |
|---|---|
| Speed of supplying the yarn for texturization | 1,070m/min. |
| Speed at which the pile leaves | 12.5m/min. |
| Speed of winding the yarn after unravelling the pile | 860m/min. |
| Supply pressure of the steam at the input of the texturization chamber | 8.5 bars |
| Temperature of the supplied steam | 142°C. |

The dyes are the same dyes used in Example 1 and are injected alternately with a variable frequency of 1 to 5 hertz and with a quantity of 90cc of dye per injector per each 265 g of yarn per minute. The lengths of the dyed sections thus produced alternately on the pile are 22mm for the 1 hertz cycle and 4.1mm for the 5 hertz cycle. On the resulting yarn which is unwound and wound, then put under tension, the lengths are 503mm for the 1 hertz cycle and 100mm for the 5 hertz cycle. As in Example 1, the measurements were taken while putting the yarn under a pre-tension of 100g, while the yarn is in the texturized state, and has a count of 2,850 dtex. The pile resulting from the dyeing treatment has the appearance of the schematically shown pile of FIG. 8.

EXAMPLE 3

This example illustrates how the process and apparatus of the present invention may be used for injection of a dye inhibiting agent at a variable frequency on a product intended to be later dyed while in the form of yarn, fabric or knit. As with Example 1, the process and apparatus described in U.S. Pat. No. 3,751,778 was combined with the process and apparatus of the instant invention to treat continuous yarn of polyhexamethylene adipamide (polyamide 66) having a count of 2,280 dtex/136 strands. The treatment was carried out under the following parameters:

| | |
|---|---|
| Supply speed of the yarn to the texturization chamber | 1,070m/min. |
| Speed of the immerging pile | 12.5m/min. |
| Winding speed of the yarn after unwinding the pile | 855m/min. |
| Supply pressure of the steam at the input of the texturization chamber | 8.5 bars |
| Temperature of the steam supplied | 142°C. |

The injection device utilized is the same as in Example 1, wherein four injectors having two channels each are utilized.

In practicing the invention as illustrated by this example, and aqueous solution of dye inhibitor, designated commercially as "Sandospace R" is injected alternately with water at frequencies of 1, 3 and 5 hertz. The aqueous solution contains the dye inhibitor at a ratio of 15g/l, and is a colorless organic substance containing a sulfonic group and a reactive group which modify the affinity of polyamide textiles for acid and cationic dyes. The solution is injected through four injectors at a delivery rate of 107cc per injector per each 265g of yarn per minute. The texturized yarn thus treated is then wound and knitted, and the knit obtained is degreased and then dyed. The dyeing takes place at 98°C., pH6, in a bath having a ratio of 1/40, with a solution which is 1g/l of soluble Kiton blue 4GL (C.I. Acid Blue 23) and 1g/l of Astrazon Red BBL (C.I. Basic Red 23) and 0.2g/l of a non-ionic wetting agent. The parts of the yarn untreated with the Sandospace R are dyed blue, and the parts of the yarn treated with the Sandospace R are dyed red. Thus, a knit with differentiated dye is obtained.

The afore-described examples, illustrations and embodiments are meant to be merely exemplary of the instant invention, which is to be limited only by the following appended claims.

What is claimed is:

1. Apparatus for impinging a plurality of dyes on compacted yarns as the yarn progresses through a crimping tube comprising:

a plurality of individual fluid circuits, wherein each circuit includes means for circulating dye therethrough;

means for connecting each of the fluid circuits to the tube;

means for diverting dye from each of the circuits through the connecting means and into the tube to impinge dye from each of the circuits on the compacted yarn;

means associated with each circuit for interrupting the circulation of dye through each circuit so as to flow the dye through the associated diverting means; and means connected to each circuit for activating each interrupting means according to selected patterns to selectively generate patterns of impingement of each of the dyes onto the compacted yarn, wherein the activating means is a reciprocating piston, which is controlled to selectively compress a fluid, and wherein the interrupting means is a diaphragm pushed by the compressed fluid to block said circuit means.

2. The apparatus of claim 1, wherein the dyes from different fluid circuits are injected into the tube at substantially the same location in the tube.

3. The apparatus of claim 2, wherein the dyes from different circuits enter the tube at substantially the same location, but are sequentially injected into the tube to form a sequential pattern on the compacted yarn.

4. The apparatus of claim 2, wherein the dye from different circuits is simultaneously injected into the tube so that the dyes from different circuits interact with one another while being impinged on the compacted yarn.

5. The apparatus of claim 1, wherein the means for connecting the fluid circuits to the tube are circumferentially spaced around the tube so that the compacted yarn has a circumferentially segmented distribution of dye treatment.

6. Apparatus for dyeing thermoplastic yarn continuously while simultaneously crimping the yarn, wherein said apparatus comprises:

tubular means for crimping the yarn while the yarn is compacted within the tubular means;

circuit means for circulating dye therethrough;

means for connecting the circuit means to the tubular means;

means for diverting dye from the circuit means through the connecting means and into the tubular means to impinge upon the compacted yarn;

means for interrupting the circulation of dye through the circuit to flow the dye through the diverting means; and means for activating the interrupting means selectively to generate a pattern of impingement of the dye into the compacted yarn, wherein the activating means is a reciprocating piston, which is controlled to selectively compress a fluid, and wherein the interrupting means is a diaphragm pushed by the compressed fluid to block said circuit means.

7. The apparatus of claim 6, wherein the diverting means includes an injector having three openings, two of which are aligned and one of which is offset, and wherein the interrupting means is located downstream of the injector so that upon activating the interrupting means, the dye is diverted from flow between the aligned openings to flow through the offset opening.

8. The apparatus of claim 6, wherein the circuit means includes a reservoir for accumulating the dye as the dye circulates to thereby provide enough dye to continually replace the dye diverted.

9. The apparatus of claim 6 wherein the fluid is air.

* * * * *